US012553288B2

(12) United States Patent
Ignova et al.

(10) Patent No.: US 12,553,288 B2
(45) Date of Patent: Feb. 17, 2026

(54) SYSTEMS AND METHODS FOR TRAJECTORY CONTROL IN A DOWNHOLE ENVIRONMENT

(71) Applicant: Schlumberger Technology Corporation, Sugar Land, TX (US)

(72) Inventors: Maja Ignova, Cheltenham (GB); Ekaterina Brovko, Cheltenham (GB); Martin Jones, Gloucester (GB); Katharine Mantle, Cheltenham (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/767,376

(22) Filed: Jul. 9, 2024

(65) Prior Publication Data

US 2026/0015909 A1 Jan. 15, 2026

(51) Int. Cl.

| | |
|---|---|
| ***E21B 7/04*** | (2006.01) |
| ***E21B 44/00*** | (2006.01) |
| ***E21B 47/024*** | (2006.01) |

(52) U.S. Cl.

CPC ..... *E21B 7/04* (2013.01); *E21B 44/00* (2013.01); *E21B 47/024* (2013.01)

(58) Field of Classification Search

CPC ... E21B 7/04; E21B 7/06; E21B 44/00; E21B 47/024

See application file for complete search history.

(56) References Cited

U.S. PATENT DOCUMENTS

| | | | | |
|---|---|---|---|---|
| 2013/0186686 | A1* | 7/2013 | Heisig | E21B 47/007 175/55 |
| 2018/0363444 | A1* | 12/2018 | Hornblower | E21B 45/00 |
| 2019/0003302 | A1* | 1/2019 | Logan | E21B 47/13 |
| 2020/0080380 | A1 | 3/2020 | Gorrara | |
| 2022/0298910 | A1* | 9/2022 | Kolbe | E21B 44/02 |
| 2023/0203931 | A1* | 6/2023 | Pho | G06N 5/022 175/24 |
| 2023/0272704 | A1 | 8/2023 | Demirer | |
| 2024/0309755 | A1* | 9/2024 | Sosareyes | E21B 47/12 |

* cited by examiner

*Primary Examiner* — Dany E Akakpo

(57) ABSTRACT

A downhole tool may store a well plan on a hardware storage device of a downhole tool. A downhole tool may drill a first portion of a borehole according to a first stage of the well plan with the downhole tool. A downhole tool may change at least one of a dogleg severity (DLS) and a rate of penetration (ROP) of the downhole tool based on a second stage of the well plan stored on the hardware storage device. A downhole tool may drill a second portion of the borehole according to the second stage of the well plan.

16 Claims, 7 Drawing Sheets

SYSTEMS AND METHODS FOR TRAJECTORY CONTROL IN A DOWNHOLE ENVIRONMENT

BACKGROUND

For drilling of a borehole, directional drilling allows creation of a non-linear borehole or a linear borehole through varying earth formations. Directional drilling units conventionally communicate with the surface to transmit status information and/or receive instructions through lengthy pulse communications. Reduction of communication time can increase the uptime of a drilling system.

SUMMARY

In some aspects, the techniques described herein relate to a method of controlling a downhole tool, the method including: storing a well plan on a hardware storage device of a downhole tool; drilling a first portion of a borehole according to a first stage of the well plan with the downhole tool; changing at least one of a dogleg severity (DLS) and a rate of penetration (ROP) of the downhole tool based on a second stage of the well plan stored on the hardware storage device; and drilling a second portion of the borehole according to the second stage of the well plan.

In some aspects, the techniques described herein relate to a method of controlling a downhole tool, the method including: storing a plurality of stages of a well plan on a hardware storage device of a downhole tool, wherein at least one stage includes a target azimuth and a target inclination; drilling a first portion of a borehole according to a first stage of the well plan with the downhole tool; setting the target azimuth and target inclination of the downhole tool based on a second stage of the well plan stored on the hardware storage device; and drilling a second portion of the borehole according to the second stage of the well plan.

In some aspects, the techniques described herein relate to a downhole control unit including: a processor; a hardware storage device having instructions stored thereon that, when executed by the processor, cause the control unit to: communicate at least one of a dogleg severity (DLS) and a rate of penetration (ROP) to another component of a bottomhole assembly (BHA) local to the downhole control unit based at least partially on a first stage of the well plan stored on the control unit; obtain at least one of a directional information, operating conditions, environmental conditions, fluid measurements, drilling mechanics information; and change at least one of the DLS and the rate of penetration ROP of the component based at least partially on the at least one of a directional information, operating conditions, environmental conditions, fluid measurements, drilling mechanics information and based at least partially on a second stage of the well plan stored on the hardware storage device.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, non-schematic drawings should be considered as being to scale for some embodiments of the present disclosure, but not to scale for other embodiments contemplated herein. Understanding that the drawings depict some example embodiments, the embodiments will be described and explained with additional specificity and detail through the use of the accompanying drawings in which.

DETAILED DESCRIPTION

Embodiments of the present disclosure generally relate to devices, systems, and methods for controlling a downhole tool in a downhole environment. Embodiments of the present disclosure generally relate to devices, systems, and methods for directional drilling. In some embodiments, systems and methods according to the present disclosure allow for the storage of a well plan on a downhole tool and the use of sensors and/or measurement devices in the downhole environment to effectuate at least a portion of the well plan.

Figure 1:
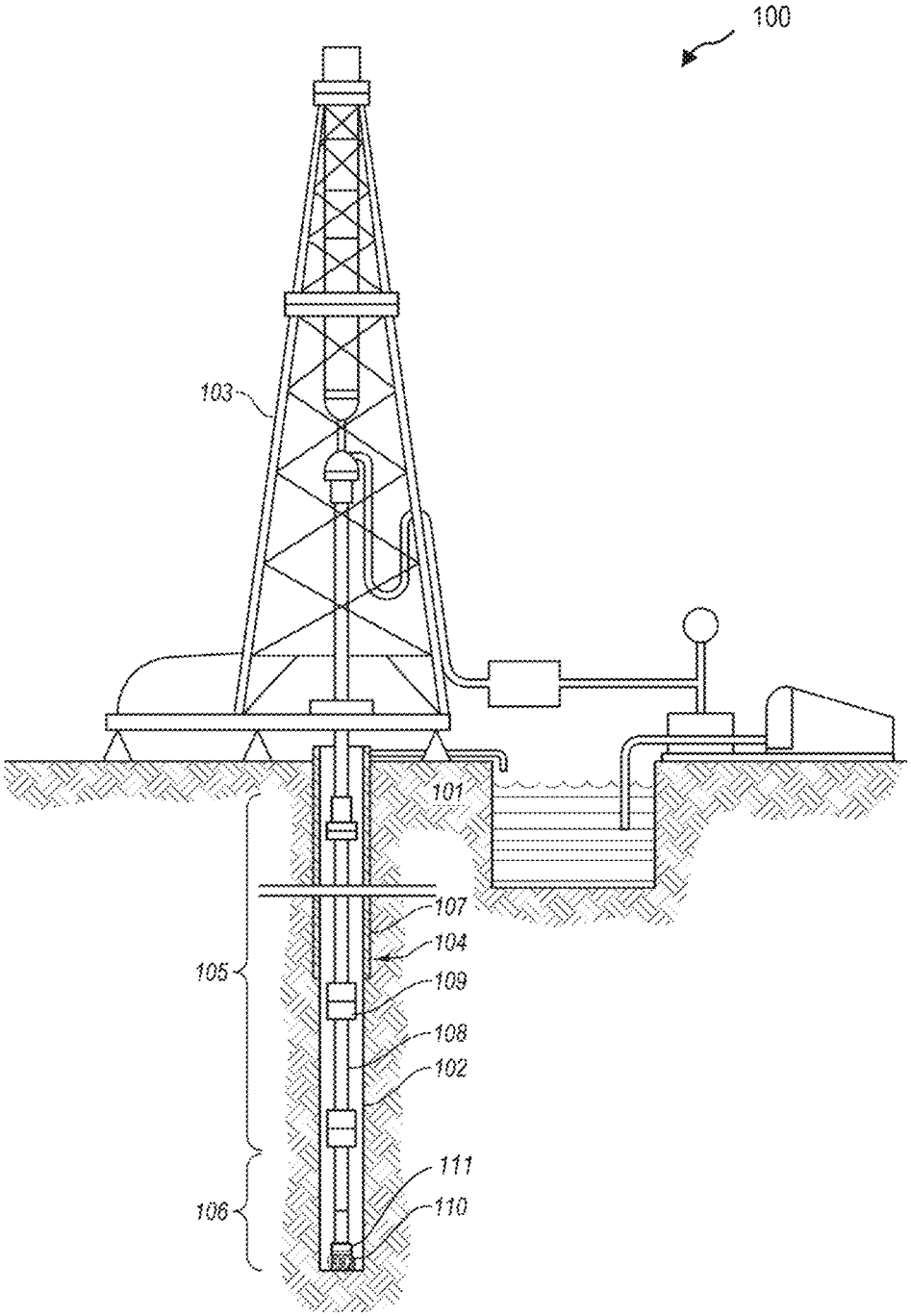
FIG. 1 illustrates a drilling system and downhole environment, according to some embodiments of the present disclosure.

FIG. 1 illustrates an embodiment of a drilling system and downhole environment. FIG. 1 shows one example of a drilling system 100 for drilling an earth formation 101 to form a borehole 102. The drilling system 100 includes a drill rig 103 used to turn a drilling assembly 104 which extends downward into the borehole 102. The drilling assembly 104 may include a drill string 105 and a bottomhole assembly (BHA) 106 attached to the downhole end of the drill string 105. Where the drilling system 100 is used for drilling formation, a drill bit 110 can be included at the downhole end of the BHA 106.

The drill string 105 may include several joints of drill pipe 108 connected end-to-end through tool joints 109. The drill string 105 transmits drilling fluid through a central bore and can transmit rotational power from the drill rig 103 to the BHA 106. In some embodiments, the drill string 105 may further include additional components such as subs, pup joints, etc. The drill pipe 108 provides a hydraulic passage through which drilling fluid 111 is pumped from the surface. The drilling fluid 111 discharges through selected-size nozzles, jets, or other orifices in the bit 110 for the purposes of cooling the bit 110 and cutting structures thereon, for lifting cuttings out of the borehole 102 as it is being drilled, and for preventing the collapse of the borehole 102. The drilling fluid 111 carries drill solids including drill fines, drill cuttings, and other swarf from the borehole 102 to the surface. The drill solids can include components from the earth formation 101, the drilling assembly 104 itself, from other man-made components (e.g., plugs, lost tools/components, etc.), or combinations thereof.

The BHA 106 may include the bit 110 or other components. An example BHA 106 may include additional or other components (e.g., coupled between to the drill string 105 and/or the bit 110). Examples of additional BHA components include drill collars, stabilizers, measurement-while-drilling (MWD) tools, logging-while-drilling (LWD) tools, downhole motors, underreamers, directional steering tools, section mills, hydraulic disconnects, jars, vibration dampening tools, other components, or combinations of the foregoing.

In general, the drilling system 100 may include other drilling components and accessories, such as special valves (e.g., kelly cocks, blowout preventers, safety valves, centrifuges, shaker tables, and rheometers). Additional components included in the drilling system 100 may be considered a part of the surface system (e.g., drill rig 103, drilling assembly 104, drill string 105, or a part of the BHA 106, depending on their locations and/or use in the drilling system 100).

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits, roller cone bits, impregnated bits, or coring bits. In other embodiments, the bit 110 may be a mill used for removing metal, composite, elastomer, other materials downhole, or combinations thereof. For instance, the bit 110 may be used with a whipstock to mill into casing 107 lining the borehole 102. The bit 110 may also be a junk mill used to mill away tools, plugs, cement, other materials within the borehole 102, or combinations thereof. Swarf or other cuttings formed by use of a mill may be lifted to surface by the drilling fluid 111 or may be allowed to fall downhole. The conditions of the equipment of the drilling system 100, the formation 101, the borehole 102, the drilling fluid 111, or other part of the wellsite can change during operations.

Figure 2:
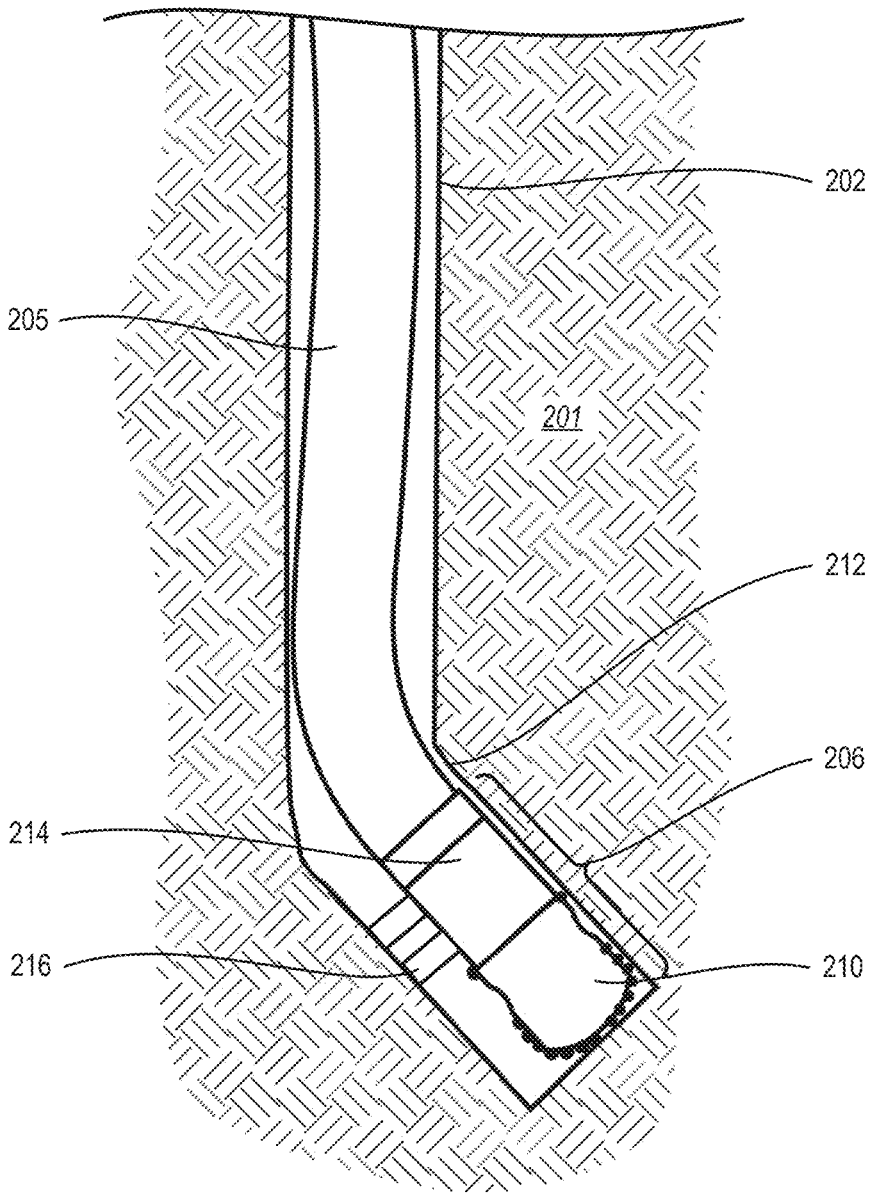
FIG. 2 is a side view of a downhole environment in which a bottomhole assembly (BHA) and drill string steer the bit to create a curve of a borehole, according to some embodiments of the present disclosure.

In some embodiments, the BHA 106 includes one or more biasing units that allow an operator to steer the bit 110 relative to the earth formation 101 as the drilling assembly 104 rotates in the borehole 102. For example, FIG. 2 is a side view of an embodiment of a downhole environment in which a BHA 206 and drill string 205 steer the bit 210 to create a curve of a borehole 202.

In some embodiments, a portion of the BHA 206 and/or drill string 205 contacts a radially inward surface 212 of the borehole 202 as the BHA 206 and drill string 205 follow the curve. In some embodiments, when the BHA 206 and drill string 205 contact the formation 201 of the borehole surface, the BHA 206 and drill string 205 experience damage from the formation 201. In some embodiments, when the BHA 206 and drill string 205 contact the formation 201 of the borehole surface, the BHA 206 and drill string 205 experience drag, in the longitudinal direction and/or the rotational direction, placing additional strain on the drilling system and components thereof. Precise control of steering the BHA 206 and the bit 210 with a directional steering tool 214 allows the drilling system to limit and/or prevent damage to the BHA 206 and drill string 205 in non-linear boreholes 202.

In some embodiments, a directional steering tool 214 is a discrete steering tool that is coupled to a drill bit 210. In some embodiments, the directional steering tool 214 is the drill bit with an integrated biasing element or steering element. For example, a directional steering tool 214 includes at least one actuatable biasing element 216 configured to actuate radially outward from a rotational axis of the BHA 206 and drill string 205. As the BHA 206 and drill string 205 rotate, the actuatable biasing element 216 is actuated between a closed position and an open position to selectively apply a lateral force to the borehole wall. The drill bit 210 is urged in an opposing lateral direction to steer the drill bit 210 and the direction of the borehole 202.

In some embodiments, an MWD unit allows for measurements of a plurality of operating conditions, environmental conditions, fluid measurements, or other status information regarding the performance and/or condition of the downhole tool and the downhole environment in which the downhole tool is operating. In some embodiments, the MWD unit measures and/or records directional information of the downhole tool. In some examples, the MWD unit includes accelerometers and/or magnetometers to measure the inclination and azimuth of the borehole at the measured location. In some embodiments, the MWD unit includes survey gyroscopes that allow directional and/or movement information, such as inclination, azimuth, velocity, and other values. In some embodiments, the MWD unit records the directional measurements. In some embodiments, the MWD unit transmits the measurements to a system and/or operator at the surface.

In some embodiments, the MWD unit measures and/or records drilling mechanics information. In some embodiments, the drilling mechanics information includes a rotational speed of the drill string; variation (vibration) in the rotational speed; amplitude, frequency, and mode of vibrations of the drill string; downhole temperature; torque on bit; weight on bit; mud flow volume; other drilling mechanics information; and combinations thereof. In some embodiments, the MWD unit records the drilling mechanics information or reports the drilling mechanics information to a control unit in the BHA 206. In some embodiments, the MWD unit transmits the drilling mechanics information to a system and/or operator at the surface.

Figure 3:
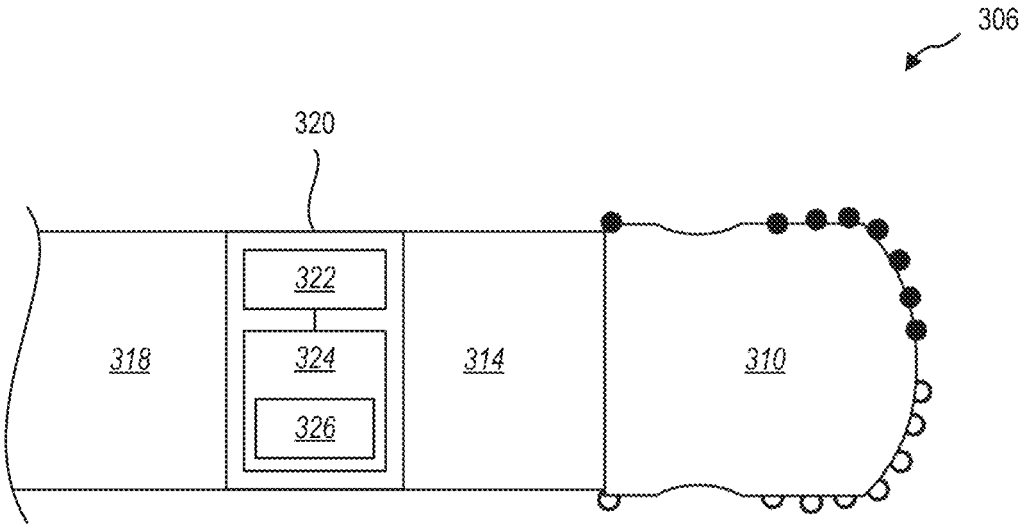
FIG. 3 is a system diagram of a BHA including a control unit, according to some embodiments of the present disclosure.

In some embodiments, the BHA includes a control unit configured to receive one or more of directional information, operating conditions, environmental conditions, fluid measurements, drilling mechanics information, or other status information, as illustrated in the embodiment of FIG. 3. In some embodiments, the control unit 320 is in data communication with at least one sensor (e.g., an MWD 318 including one or more sensors) and a directional steering tool 314. In some embodiments, the control unit 320 is integrated with the MWD 318 and/or the direction steering tool 314. The control unit 320 includes a processor 322 and a hardware storage device 324 in data communication with the processor 322. The hardware storage device 324 has instructions stored thereon that, when executed by the processor 322, cause the BHA 306 to perform at least a portion of any method described herein.

In some embodiments, the hardware storage device 324 has a well plan 326 stored thereon. In some embodiments, the well plan 326 is loaded to the hardware storage device 324 at the surface of the drilling system prior to running the BHA 306 (including the control unit 320) downhole. In some embodiments, the well plan 326 includes a plurality of stages of the well plan 326. The control unit 320 obtains at least one of the directional information, operating conditions, environmental conditions, fluid measurements, drilling mechanics information, or other status information from one or more sensors of the BHA 306. In at least one example, the sensors are in or part of the MWD 318.

In some embodiments, the well plan 326 includes triggers indicating a transition from a first stage of the well plan 326 to a second stage, from the second stage to a third stage, etc. In some embodiments, a trigger is or includes one or more of a true vertical depth (TVD) of the BHA and/or downhole tool, an inclination of the BHA and/or downhole tool, an azimuth of the BHA and/or downhole tool, a toolface of the BHA and/or downhole tool, a formation measurement or other environmental measurement, or combinations thereof. In some embodiments, a trigger is or includes a single downlink communication from a surface of the drilling system to increment or select a stage of the well plan, as will be described herein.

A formation measurement is, in some examples, a measurement of at least one property of the formation through which the BHA 306 is drilling or otherwise located. For example, a formation measurement includes a formation fluid composition, a formation solids composition (e.g., geochemistry), a formation hardness, a formation porosity, a formation fluid flowrate, a formation homogeneity, etc. In some embodiments, the formation measurement is made by one or more sensors of the BHA 306. In some embodiments, the formation measurement is made by sensors in the drill bit 310. In some embodiments, the formation measurement is made by sensors in the MWD 318. In some embodiments, the formation measurement is made by sensors in the directional steering tool 314.

An environmental measurement is, in some examples, a measurement of at least one property of the downhole environment that may or may not be related to the formation through which the BHA 306 drills or is located. For example, an environmental measurement may include temperature, pressure, or other measurements that are not formation measurements but inform the drilling system of downhole conditions. In some embodiments, the environmental measurement is made by one or more sensors of the BHA 306. In some embodiments, the environmental measurement is made by sensors in the drill bit 310. In some embodiments, the environmental measurement is made by sensors in the MWD 318. In some embodiments, the environmental measurement is made by sensors in the directional steering tool 314.

In some embodiments, the control unit 320 obtains (e.g., receives, collects, measures, determines) a trigger that causes the control unit 320 to change one or more operating value of the BHA 306 and/or drilling system. In some embodiments, the control unit 320 changes a rate of penetration (ROP) of the BHA 306. For example, the control unit 320 may instruct a turbine of the drill bit 310 to increase the ROP. In other examples, the control unit 320 may communicate uphole with one or more components of the drilling system and/or drill string to increase the ROP. In some embodiments, the control unit 320 changes a dogleg severity (DLS) (e.g., a radius of curvature of the borehole) of the BHA 306. In some examples, the control unit 320 communicates with the directional steering tool 314 to change the DLS or other lateral movement of the BHA 306 through actuation of bias pads of the directional steering tool 314.

In some embodiments, the control unit 320 changes the ROP and/or DLS of the BHA 306 based at least partially on different parameters depending on the stage of the well plan. For example, a trigger to change from the first stage of the well plan to a second stage of the well plan may be a detected toolface of the BHA 306, while the trigger to change from the second stage of the well plan to a third stage of the well plan may be a detected change in formation fluid (or other formation measurement) corresponding to the BHA 306 entering an expected layer of the formation.

In some embodiments, the trigger causes the control unit 320 to change a target azimuth and/or target inclination of the BHA 306. For example, the control unit 320 may determine that the BHA 306 has completed a first stage of the well plan, and the control unit 320 a target azimuth and inclination for a second stage of the well plan to drill a linear stage of the well plan. In at least one example, the control unit 320 instructs the directional steering tool 314 to achieve and/or maintain the target azimuth and/or inclination values.

Figure 4:
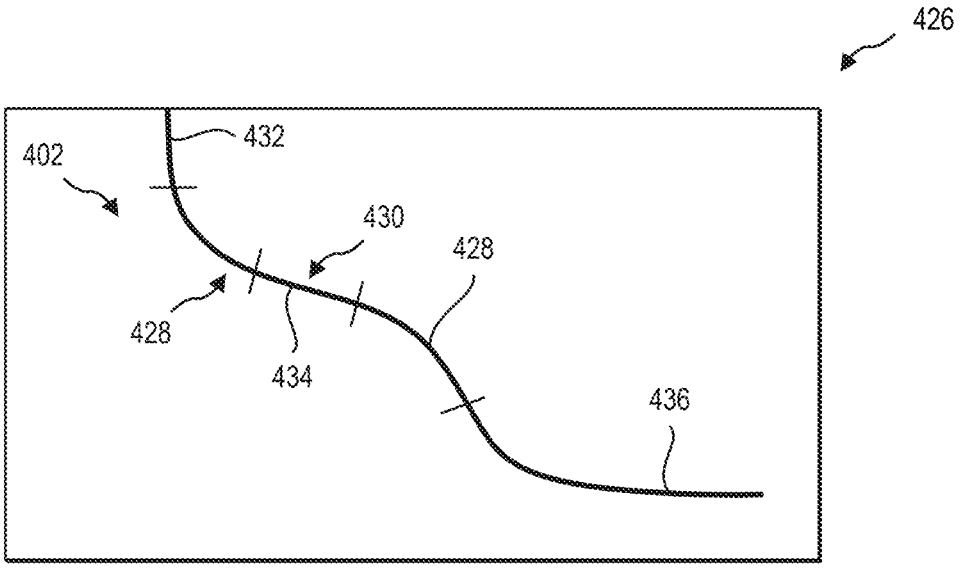
FIG. 4 is a schematic representation of an embodiment of a well plan stored on a hardware storage device of a control unit and/or BHA, according to some embodiments of the present disclosure.

FIG. 4 is a schematic representation of an embodiment of a well plan 426 stored on a hardware storage device of a control unit and/or BHA described herein. In some embodiments, the well plan 426 includes a plurality of stages with transitions therebetween. For example, the well plan 426 may include a curved stage 428 and/or a linear stage 430. In some embodiments, the well plan 426 includes a plurality of curved stages 428 and linear stages 430. In some embodiments, the well plan 426 includes at least one vertical stage 432. In some embodiments, the well plan 426 includes a landing stage 434.

A curved stage 428 is any stage of the well plan 426 in which at least one of the inclination and the azimuth of the borehole 402 changes along a length of the stage. While the schematic illustration of FIG. 4 depicts an embodiment of a curved stage 428 with a change in inclination along a length of the curved stage 428, it should be understood that in some embodiments of a curved stage the inclination is substantially constant and the azimuth of the borehole 402 changes. In some embodiments, both the inclination and the azimuth of the borehole 402 changes in the curved stage 428.

A linear stage 430 is any stage of the well plan 426 in which the inclination and azimuth of the borehole 402 remains constant along the length of the stage. In some embodiments, a linear stage 430 is a vertical stage 432 of the well plan 426 in which the inclination is substantially vertical relative to a direction of gravity. For example, a vertical stage 432 may be an initial stage from the surface. In such an example, the trigger to change from the vertical stage 432 to a second stage (e.g., curved stage 428) may be the TVD relative to the surface. In some embodiments, a linear stage 430 of the well plan 426 is a directional stage 434 in which the inclination and azimuth are substantially constant, while the inclination is non-vertical, creating a lateral net movement of the borehole 402 along the length of the directional stage 434 relative to the direction of gravity.

In some embodiments, the well plan 426 includes a landing stage 436. In some embodiments, the landing stage 436 is a curved stage in which the borehole 402 attains a substantially horizontal orientation relative to the direction of gravity. In some embodiments, the landing stage 436 is a final stage of the well plan 426. For example, a trigger for changing to the landing stage 436 may include a formation composition, as the borehole 402 turns and runs horizontally to remain within the formation when the desired formation composition is detected.

Figure 5:
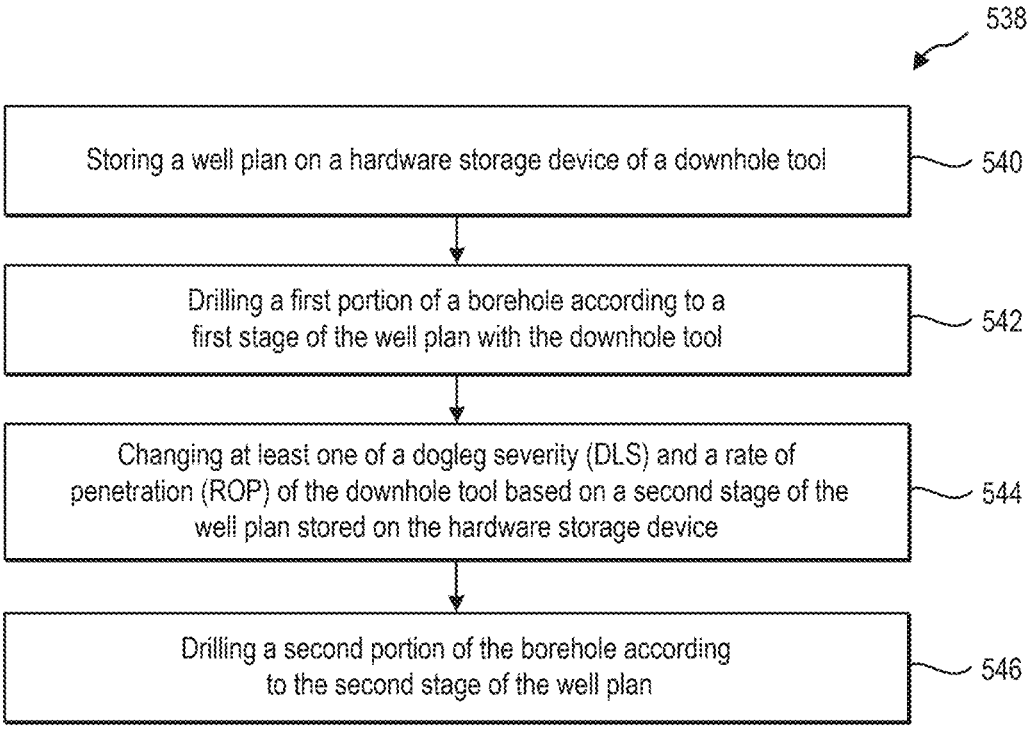
FIG. 5 is a flowchart illustrating a method of automatically executing a well plan with a downhole control unit, according to some embodiments of the present disclosure.

FIG. 5 is a flowchart illustrating an embodiment of a method 538 of automatically executing a well plan with a downhole control unit. In some embodiments, the method 538 includes storing a well plan on a hardware storage device of a downhole tool at 540. In some embodiments, the well plan is stored locally on the hardware storage device of the control unit, such as described in relation to FIG. 3. In some embodiments, the well plan is at least partially stored on a hardware storage device of another downhole component, such as a directional steering tool. In some examples, the control unit includes a well plan consisting of pre-determined stages that are stored on the directional steering tool, such as a first curved stage with a first pre-determined DLS and a second curved stage with a second pre-determined DLS. The control unit communicates with the directional steering tool to change the directional steering tool from the first curved stage to the second curved stage, although the portion of the well plan stored on the control unit does not include the specific values or parameters of the first curved stage and second curved stage.

In some embodiments, the method 538 includes drilling a first portion of a borehole according to a first stage of the well plan with the downhole tool at 542. The drilling system drills the first portion of the borehole according to the values associated with the first stage, such as a DLS for a curved stage, a target azimuth and/or inclination for a linear stage, an ROP, or other drilling parameters. In some embodiments, one of more components of the drilling system dynamically adjust values to meet the target values of the well plan. For example, the directional steering tool may dynamically adjust lateral forces applied by actuatable bias pads to hold a target inclination and/or azimuth. In another example, the drilling system dynamically adjusts a rotational speed of the drill bit to maintain a target ROP according to the well plan.

The method 538 further includes changing at least one of a DLS and an ROP of the downhole tool based on a second stage of the well plan stored on the hardware storage device at 544 and drilling a second portion of the borehole according to the second stage of the well plan at 546. In some embodiments, changing at least one of the DLS and the ROP includes obtaining a trigger that instructs the control unit to change the at least one of the DLS and the ROP. In some examples, obtaining the trigger includes receiving, collecting, measuring, determining, or combinations thereof one or more values that meet or exceed a trigger value of the well plan.

In some embodiments, a trigger is or includes directional information, a formation measurement, environmental measurement, or combinations thereof. In some embodiments, directional information includes one or more of a true vertical depth (TVD) of the BHA and/or downhole tool, an inclination of the BHA and/or downhole tool, an azimuth of the BHA and/or downhole tool, a toolface of the BHA and/or downhole tool, a formation measurement or other environmental measurement, or combinations thereof.

A formation measurement is, in some examples, a measurement of at least one property of the formation through which the BHA is drilling or otherwise located. For example, a formation measurement includes a formation fluid composition, a formation solids composition (e.g., geochemistry), a formation hardness, a formation porosity, a formation fluid flowrate, a formation homogeneity, etc. In some embodiments, the formation measurement is made by one or more sensors of the BHA. In some embodiments, the formation measurement is made by sensors in the drill bit. In some embodiments, the formation measurement is made by sensors in the MWD. In some embodiments, the formation measurement is made by sensors in the directional steering tool.

An environmental measurement is, in some examples, a measurement of at least one property of the downhole environment that may or may not be related to the formation through which the BHA drills or is located. For example, an environmental measurement may include temperature, pressure, or other measurements that are not formation measurements but inform the drilling system of downhole conditions. In some embodiments, the environmental measurement is made by one or more sensors of the BHA. In some embodiments, the environmental measurement is made by sensors in the drill bit. In some embodiments, the environmental measurement is made by sensors in the MWD. In some embodiments, the environmental measurement is made by sensors in the directional steering tool.

The control unit communicates with one or more components of the BHA and/or the drilling system to change at least DLS and ROP target values of the drilling system from those of the first stage to those of the second stage. The drilling system then drills the second stage of the borehole according to the well plan at 546.

Figure 6:
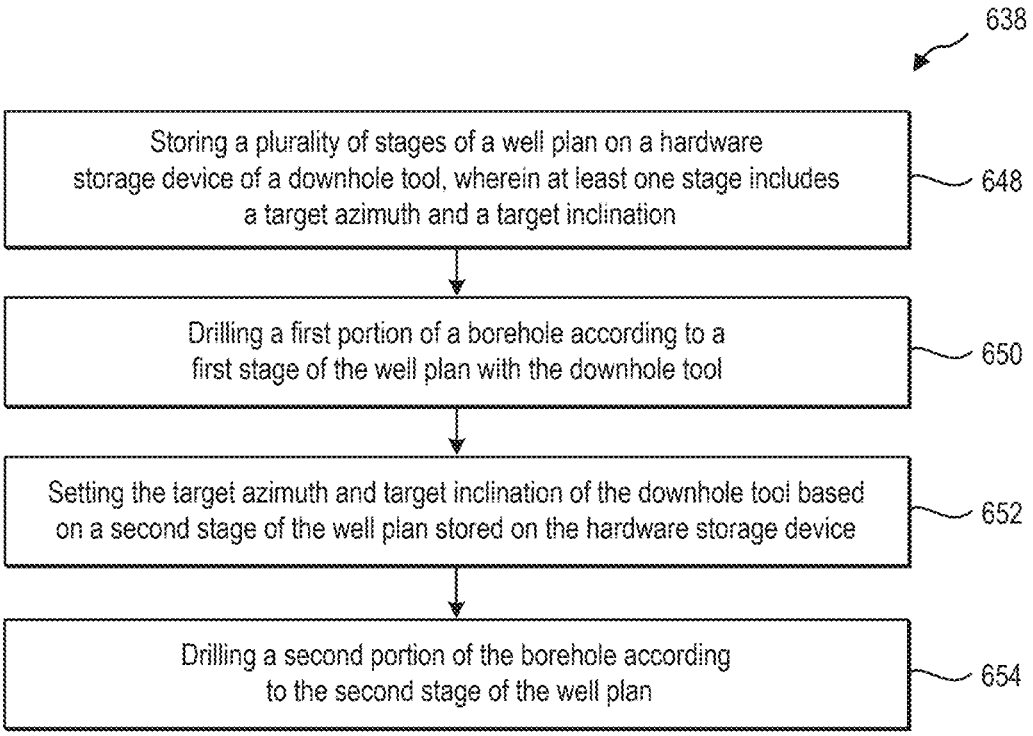
FIG. 6 is a flowchart illustrating a method of automatically setting target directional values according to a well plan with a downhole control unit, according to some embodiments of the present disclosure.

FIG. 6 is a flowchart illustrating an embodiment of a method 638 of automatically executing a well plan with a downhole control unit. In some embodiments, the method 638 includes storing a plurality of stages of a well plan on a hardware storage device of a downhole tool, wherein at least one stage includes a target azimuth and a target inclination, at 648. In some embodiments, the well plan is stored locally on the hardware storage device of the control unit, such as described in relation to FIG. 3. In some embodiments, the well plan is at least partially stored on a hardware storage device of another downhole component, such as a directional steering tool. In some examples, the control unit includes a well plan comprising pre-determined stages that are stored on the directional steering tool, such as a first stage with a first target azimuth and/or inclination and a second stage with a second target azimuth and/or inclination. The control unit communicates with the directional steering tool to change the directional steering tool from the first stage to the second stage, although the portion of the well plan stored on the control unit will not include the specific values or parameters of the first stage and second stage.

In some embodiments, the method 638 further includes drilling a first portion of a borehole according to a first stage of the well plan with the downhole tool at 650. The drilling system drills the first portion of the borehole according to the values associated with the first stage, such as a DLS for a curved stage, a target azimuth and/or inclination for a linear stage, an ROP, or other drilling parameters. In some embodiments, one of more components of the drilling system dynamically adjust values to meet the target values of the well plan. For example, the directional steering tool may dynamically adjust lateral forces applied by actuatable bias pads to hold a target inclination and/or azimuth. In another example, the drilling system dynamically adjusts a rotational speed of the drill bit to maintain a target ROP according to the well plan.

The method 638 further includes setting the target azimuth and target inclination of the downhole tool based on a second stage of the well plan stored on the hardware storage device at 652 and drilling a second portion of the borehole according to the second stage of the well plan at 654. In some embodiments, setting the target azimuth and target inclination of the downhole tool based on a second stage of the well plan includes generating a curved stage therebetween. For example, the first stage may be a vertical stage, and the second stage may be a directional stage with a 45° inclination. In some embodiments, the control unit (or other component of the BHA, such as the directional steering tool) generates a curved stage therebetween with a DLS based on the drilling mechanics information or other drilling system information. For example, the drilling system is unable to instantaneously change from the first stage to the second stage in the described example, and the control unit has drilling system information stored thereon regarding the maximum DLS (minimum radius of curvature) of a borehole possible with the drilling system. In some embodiments, the control unit generates and sets one or more values of the directional steering tool based on the curved stage needed between the first stage and the second stage.

In at least one embodiment, the control unit generates the curved stage between the first stage and the second stage based on the well plan stored thereon prior to setting the target azimuth and target inclination of the downhole tool based on a second stage of the well plan stored on the hardware storage device at 652. For example, the control unit may evaluate the well plan for discontinuities between stages of the well plan and generate curved stages therebetween without user input. In at least one example, the curved stage between a first stage and a second stage may overlap with and/or shorten at least one of the first stage and the second stage to retain an intended endpoint of the second stage.

In some embodiments, the downhole measurements, such as directional measurements, formation measurements, and environmental measurements are imprecise or unavailable. In such situations, the control unit may receive downlink communications from the surface of the drilling system to increment a stage or select a stage from the well plan based on a single downlink communication. Conventional downlink communications can include five or more discrete downlink communications to change settings of the BHA and change stages. Reducing the downlink communication duration can increase uptime on the drilling system.

Figure 7:
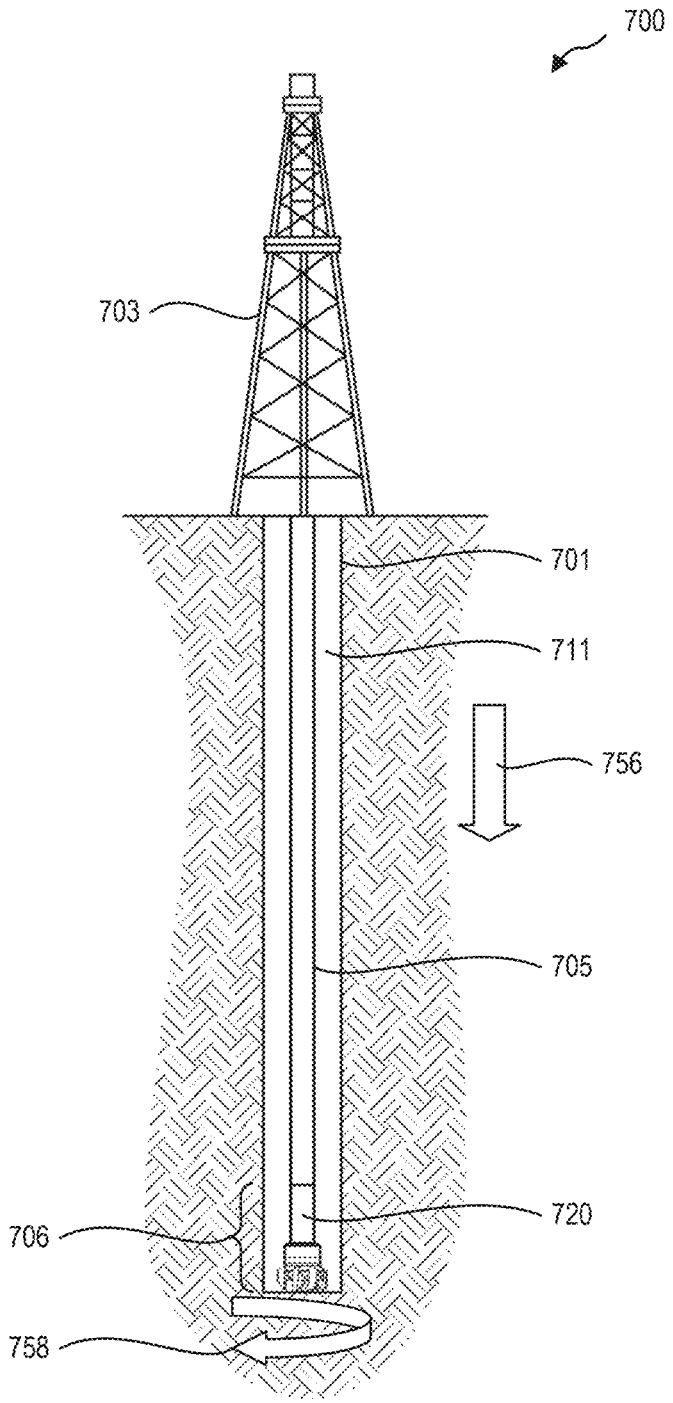
FIG. 7 is a schematic diagram of downlink communications, according to some embodiments of the present disclosure.

FIG. 7 is a diagram of downlink communications that may be used to communicate "shorthand" instructions to the control unit 720 based on the well plan stored locally in the control unit 720 and/or BHA 706. In some embodiments, the drilling system 700 can communicate downhole with the control unit 720 and/or BHA 706 by mud pulses 756. For example, a drilling fluid 711 or mud flows downward through the drill string 705 to the control unit 720 and/or BHA 706 as described herein. By varying a flow rate and/or a fluid pressure of the drilling fluid 711, the drilling rig 703 at the surface of the drilling system 700 can transmit instructions to the control unit 720 and/or BHA 706. In a conventional system, the downlink communication includes a plurality of mud pulses 756 in the downhole direction, where each mud pulse 756 is of varying duration to communicate or select settings in the BHA 706. In some examples, the borehole 701 and/or drill string 705 can be long, introducing fluidic drag into the mud pulses 756, requiring each mud pulse to be a minute or longer. A sequence of mud pulses 756, therefore, can take several minutes or longer to communicate a relatively simple change to BHA settings.

In some embodiments, the drilling system 700 can communicate downhole with the control unit 720 and/or BHA 706 by RPM pulses 758. For example, the drilling rig applies a torque to change the revolutions per minute (RPM) of the drill string 705 to communicate with the control unit 720 and/or BHA 706. By varying an RPM of the drill string 705 through a series of changes or at a particular RPM, the drilling rig 703 at the surface of the drilling system 700 can transmit instructions to the control unit 720 and/or BHA 706. In a conventional system, the downlink communication includes a plurality of RPM pulses 758, where each RPM pulses 758 is of varying duration and/or RPM to communicate or select settings in the BHA 706. In some examples, the borehole 701 and/or drill string 705 can be long, introducing significant torsional elasticity, fluidic drag, friction with a borehole wall and other variables into the communication of the transmission of the RPM pulse 758 in the downhole direction. The delay and/or noise (e.g., torsional oscillations) in the transmission of the RPM pulses 758 can require each RPM pulse 758 to be a minute or longer to effectively communicate the signal to the control unit 720 and/or BHA 706. A sequence of RPM pulses 758, therefore, can take several minutes or longer to communicate a relatively simple change to BHA settings.

Figure 8:
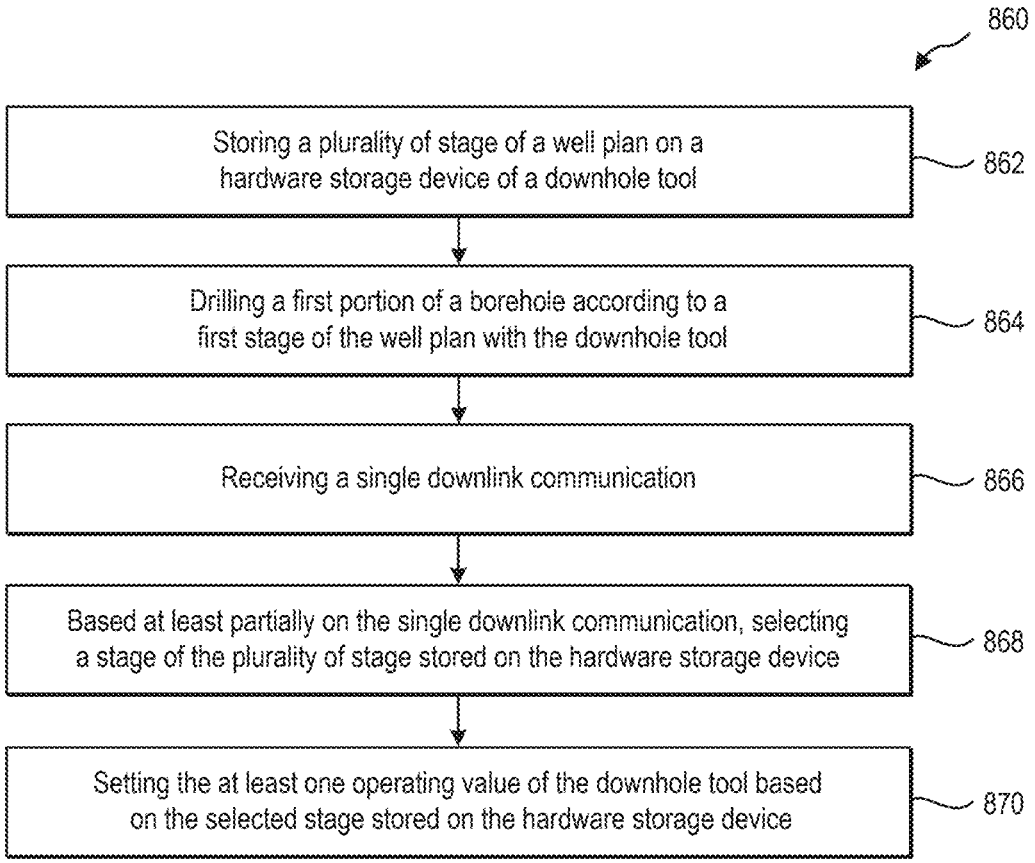
FIG. 8 is a flowchart illustrating a method of changing stages of a well plan with a downhole control unit using a single downlink communication, according to some embodiments of the present disclosure.

FIG. 8 is a flowchart illustrating an embodiment of a method 860 of changing stages of a well plan with a downhole control unit using a single downlink communication, significantly shortening the communication duration and increasing uptime on the drilling system. In some embodiments, the method 860 includes storing a plurality of stages of a well plan on a hardware storage device of a downhole tool at 862. In some embodiments, the well plan is stored locally on the hardware storage device of the control unit, such as described in relation to FIG. 3. In some embodiments, the well plan is at least partially stored on a hardware storage device of another downhole component, such as a directional steering tool. In some examples, the control unit includes a well plan of pre-determined stages that are stored on the directional steering tool, such as a first stage with a first target azimuth and/or inclination and a second stage with a second target azimuth and/or inclination. The control unit communicates with the directional steering tool to change the directional steering tool from the first stage to the second stage, although the portion of the well plan stored on the control unit will not include the specific values or parameters of the first stage and second stage.

In some embodiments, the method 860 further includes drilling a first portion of a borehole according to a first stage of the well plan with the downhole tool at 864. The drilling system drills the first portion of the borehole according to the values associated with the first stage, such as a DLS for a curved stage, a target azimuth and/or inclination for a linear stage, an ROP, or other drilling parameters. In some embodiments, one of more components of the drilling system dynamically adjust values to meet the target values of the well plan. For example, the directional steering tool may dynamically adjust lateral forces applied by actuatable bias pads to hold a target inclination and/or azimuth. In another example, the drilling system dynamically adjusts a rotational speed of the drill bit to maintain a target ROP according to the well plan.

The method 860 further includes receiving a single downlink communication at the control unit and/or BHA at 866. In some embodiments, the single downlink communication is a mud pulse communication. In some embodiments, the single downlink communication is an RPM pulse. Based at least partially on the single downlink communication, the method 860 includes selecting a stage of the plurality of stages stored on the hardware storage device at 868. For example, the single downlink communication may instruct the control unit to increment the well plan forward one stage, selecting the next stage in the well plan. In some examples, the single downlink communication may instruct the control unit to select a sixth stage from the plurality of stages. In such an embodiment, the well plan may be dynamically adjusted or changed based on the downlink communications by building a well plan or profile through selections of a pre-determined set of stages. By selecting pre-determined stages from the plurality of stages stored on the hardware storage device, a plurality of settings or values can be changed by the control unit based on a single downlink communication.

The method 860 further includes setting at least one operating value (target azimuth, target inclination, ROP, DLS, etc.) of the downhole tool based on the selected stage stored on the hardware storage device at 868 and drilling a second portion of the borehole according to the second stage of the well plan at 870.

Embodiments of the present disclosure generally relate to devices, systems, and methods for controlling a downhole tool in a downhole environment. Embodiments of the present disclosure generally relate to devices, systems, and methods for directional drilling. In some embodiments, systems and methods according to the present disclosure allow for the storage of a well plan on a downhole tool and the use of sensors and/or measurement devices in the downhole environment to effectuate at least a portion of the well plan.

In some embodiments, a BHA includes a control unit and is configured to receive one or more of directional information, operating conditions, environmental conditions, fluid measurements, drilling mechanics information, or other status information. In some embodiments, the control unit is in data communication with at least one sensor (e.g., an MWD including one or more sensors) and a directional steering tool. In some embodiments, the control unit is integrated with the MWD and/or the direction steering tool. The control unit includes a processor and a hardware storage device in data communication with the processor. The hardware storage device has instructions stored thereon that, when executed by the processor, cause the BHA to perform at least a portion of any method described herein.

In some embodiments, the hardware storage device has a well plan stored thereon. In some embodiments, the well plan is loaded to the hardware storage device at the surface of the drilling system prior to running the BHA (including the control unit) downhole. In some embodiments, the well plan includes a plurality of stages of the well plan. The control unit obtains at least one of the directional information, operating conditions, environmental conditions, fluid measurements, drilling mechanics information, or other status information from one or more sensors of the BHA. In at least one example, the sensors are in or part of the MWD.

In some embodiments, the well plan includes triggers indicating a transition from a first stage of the well plan to a second stage, from the second stage to a third stage, etc. In some embodiments, a trigger is or includes one or more of a true vertical depth (TVD) of the BHA and/or downhole tool, an inclination of the BHA and/or downhole tool, an azimuth of the BHA and/or downhole tool, a toolface of the BHA and/or downhole tool, a formation measurement or other environmental measurement, or combinations thereof. In some embodiments, a trigger is or includes a single downlink communication from a surface of the drilling system to increment or select a stage of the well plan, as will be described herein.

A formation measurement is, in some examples, a measurement of at least one property of the formation through which the BHA is drilling or otherwise located. For example, a formation measurement includes a formation fluid composition, a formation solids composition (e.g., geochemistry), a formation hardness, a formation porosity, a formation fluid flowrate, a formation homogeneity, etc. In some embodiments, the formation measurement is made by one or more sensors of the BHA. In some embodiments, the formation measurement is made by sensors in the drill bit. In some embodiments, the formation measurement is made by sensors in the MWD. In some embodiments, the formation measurement is made by sensors in the directional steering tool.

An environmental measurement is, in some examples, a measurement of at least one property of the downhole environment that may or may not be related to the formation through which the BHA drills or is located. For example, an environmental measurement may include temperature, pressure, or other measurements that are not formation measurements but inform the drilling system of downhole conditions. In some embodiments, the environmental measurement is made by one or more sensors of the BHA. In some embodiments, the environmental measurement is made by sensors in the drill bit. In some embodiments, the environmental measurement is made by sensors in the MWD. In some embodiments, the environmental measurement is made by sensors in the directional steering tool.

In some embodiments, the control unit obtains (e.g., receives, collects, measures, determines) a trigger that causes the control unit to change one or more operating value of the BHA and/or drilling system. In some embodiments, the control unit changes a rate of penetration (ROP) of the BHA. For example, the control unit may instruct a turbine of the drill bit to increase the ROP. In other examples, the control unit may communicate uphole with one or more components of the drilling system and/or drill string to increase the ROP. In some embodiments, the control unit changes a dogleg severity (DLS) (e.g., a radius of curvature of the borehole) of the BHA. In some examples, the control unit communicates with the directional steering tool to change the DLS or other lateral movement of the BHA through actuation of bias pads of the directional steering tool.

In some embodiments, the control unit changes the ROP and/or DLS of the BHA based at least partially on different parameters depending on the stage of the well plan. For example, a trigger to change from the first stage of the well plan to a second stage of the well plan may be a detected toolface of the BHA, while the trigger to change from the second stage of the well plan to a third stage of the well plan may be a detected change in formation fluid (or other formation measurement) corresponding to the BHA entering an expected layer of the formation.

In some embodiments, the trigger causes the control unit to change a target azimuth and/or target inclination of the BHA. For example, the control unit may determine that the BHA has completed a first stage of the well plan, and the control unit a target azimuth and inclination for a second stage of the well plan to drill a linear stage of the well plan. In at least one example, the control unit instructs the directional steering tool to achieve and/or maintain the target azimuth and/or inclination values.

In some embodiments, the well plan includes a plurality of stages with transitions therebetween. For example, the well plan may include a curved stage and/or a linear stage. In some embodiments, the well plan includes a plurality of curved stages and linear stages. In some embodiments, the well plan includes at least one vertical stage. In some embodiments, the well plan includes a landing stage.

A curved stage is any stage of the well plan in which at least one of the inclination and the azimuth of the borehole changes along a length of the stage. It should be understood that in some embodiments of a curved stage the inclination is substantially constant and the azimuth of the borehole changes. In some embodiments, both the inclination and the azimuth of the borehole changes in the curved stage.

A linear stage is any stage of the well plan in which the inclination and azimuth of the borehole remains constant along the length of the stage. In some embodiments, a linear stage is a vertical stage of the well plan in which the inclination is substantially vertical relative to a direction of gravity. For example, a vertical stage may be an initial stage from the surface. In such an example, the trigger to change from the vertical stage to a second stage (e.g., curved stage) may be the TVD relative to the surface. In some embodiments, a linear stage of the well plan is a directional stage in which the inclination and azimuth are substantially constant, while the inclination is non-vertical, creating a lateral net movement of the borehole along the length of the directional stage relative to the direction of gravity.

In some embodiments, the well plan includes a landing stage. In some embodiments, the landing stage is a curved stage in which the borehole attains a substantially horizontal orientation relative to the direction of gravity. In some embodiments, the landing stage is a final stage of the well plan. For example, a trigger for changing to the landing stage may include a formation composition, as the borehole turns and runs horizontally to remain within the formation when the desired formation composition is detected.

In some embodiments, a method of automatically executing a well plan with a downhole control unit includes storing a well plan on a hardware storage device of a downhole tool. In some embodiments, the well plan is stored locally on the hardware storage device of the control unit, such as described herein. In some embodiments, the well plan is at least partially stored on a hardware storage device of another downhole component, such as a directional steering tool. In some examples, the control unit includes a well plan including pre-determined stages that are stored on the directional steering tool, such as a first curved stage with a first pre-determined DLS and a second curved stage with a second pre-determined DLS. The control unit communicates with the directional steering tool to change the directional steering tool from the first curved stage to the second curved stage, although the portion of the well plan stored on the control unit does not include the specific values or parameters of the first curved stage and second curved stage.

In some embodiments, the method includes drilling a first portion of a borehole according to a first stage of the well plan with the downhole tool. The drilling system drills the first portion of the borehole according to the values associated with the first stage, such as a DLS for a curved stage, a target azimuth and/or inclination for a linear stage, an ROP, or other drilling parameters. In some embodiments, one or more components of the drilling system dynamically adjust values to meet the target values of the well plan. For example, the directional steering tool may dynamically adjust lateral forces applied by actuatable bias pads to hold a target inclination and/or azimuth. In another example, the drilling system dynamically adjusts a rotational speed of the drill bit to maintain a target ROP according to the well plan.

The method further includes changing at least one of a DLS and an ROP of the downhole tool based on a second stage of the well plan stored on the hardware storage device and drilling a second portion of the borehole according to the second stage of the well plan. In some embodiments, changing at least one of the DLS and the ROP includes obtaining a trigger that instructs the control unit to change the at least one of the DLS and the ROP. In some examples, obtaining the trigger includes receiving, collecting, measuring, determining, or combinations thereof one or more values that meet or exceed a trigger value of the well plan.

In some embodiments, a trigger is or includes directional information, a formation measurement, environmental measurement, or combinations thereof. In some embodiments, directional information includes one or more of a true vertical depth (TVD) of the BHA and/or downhole tool, an inclination of the BHA and/or downhole tool, an azimuth of the BHA and/or downhole tool, a toolface of the BHA and/or downhole tool, a formation measurement or other environmental measurement, or combinations thereof.

A formation measurement is, in some examples, a measurement of at least one property of the formation through which the BHA is drilling or otherwise located. For example, a formation measurement includes a formation fluid composition, a formation solids composition (e.g., geochemistry), a formation hardness, a formation porosity, a formation fluid flowrate, a formation homogeneity, etc. In some embodiments, the formation measurement is made by one or more sensors of the BHA. In some embodiments, the formation measurement is made by sensors in the drill bit. In some embodiments, the formation measurement is made by sensors in the MWD. In some embodiments, the formation measurement is made by sensors in the directional steering tool.

An environmental measurement is, in some examples, a measurement of at least one property of the downhole environment that may or may not be related to the formation through which the BHA drills or is located. For example, an environmental measurement may include temperature, pressure, or other measurements that are not formation measurements but inform the drilling system of downhole conditions. In some embodiments, the environmental measurement is made by one or more sensors of the BHA. In some embodiments, the environmental measurement is made by sensors in the drill bit. In some embodiments, the environmental measurement is made by sensors in the MWD. In some embodiments, the environmental measurement is made by sensors in the directional steering tool.

The control unit communicates with one or more components of the BHA and/or the drilling system to change at least DLS and ROP target values of the drilling system from those of the first stage to those of the second stage. The drilling system then drills the second stage of the borehole according to the well plan.

In some embodiments, a method of automatically executing a well plan with a downhole control unit includes storing a plurality of stages of a well plan on a hardware storage device of a downhole tool, wherein at least one stage includes a target azimuth and a target inclination. In some embodiments, the well plan is stored locally on the hardware storage device of the control unit, such as described herein. In some embodiments, the well plan is at least partially stored on a hardware storage device of another downhole component, such as a directional steering tool. In some examples, the control unit includes a well plan of predetermined stages that are stored on the directional steering tool, such as a first stage with a first target azimuth and/or inclination and a second stage with a second target azimuth and/or inclination. The control unit communicates with the directional steering tool to change the directional steering tool from the first stage to the second stage, although the portion of the well plan stored on the control unit will not include the specific values or parameters of the first stage and second stage.

In some embodiments, the method further includes drilling a first portion of a borehole according to a first stage of the well plan with the downhole tool. The drilling system drills the first portion of the borehole according to the values associated with the first stage, such as a DLS for a curved stage, a target azimuth and/or inclination for a linear stage, an ROP, or other drilling parameters. In some embodiments, one of more components of the drilling system dynamically adjust values to meet the target values of the well plan. For example, the directional steering tool may dynamically adjust lateral forces applied by actuatable bias pads to hold a target inclination and/or azimuth. In another example, the drilling system dynamically adjusts a rotational speed of the drill bit to maintain a target ROP according to the well plan.

The method further includes setting the target azimuth and target inclination of the downhole tool based on a second stage of the well plan stored on the hardware storage device and drilling a second portion of the borehole according to the second stage of the well plan. In some embodiments, setting the target azimuth and target inclination of the downhole tool based on a second stage of the well plan includes generating a curved stage therebetween. For example, the first stage may be a vertical stage, and the second stage may be a directional stage with a 45° inclination. In some embodiments, the control unit (or other component of the BHA, such as the directional steering tool) generates a curved stage therebetween with a DLS based on the drilling mechanics information or other drilling system information. For example, the drilling system is unable to instantaneously change from the first stage to the second stage in the described example, and the control unit has drilling system information stored thereon regarding the maximum DLS (minimum radius of curvature) of a borehole possible with the drilling system. In some embodiments, the control unit generates and sets one or more values of the directional steering tool based on the curved stage needed between the first stage and the second stage.

In at least one embodiment, the control unit generates the curved stage between the first stage and the second stage based on the well plan stored thereon prior to setting the target azimuth and target inclination of the downhole tool based on a second stage of the well plan stored on the hardware storage device. For example, the control unit may evaluate the well plan for discontinuities between stages of the well plan and generate curved stages therebetween without user input. In at least one example, the curved stage between a first stage and a second stage may overlap with and/or shorten at least one of the first stage and the second stage to retain an intended endpoint of the second stage.

In some embodiments, the downhole measurements, such as directional measurements, formation measurements, and environmental measurements are imprecise or unavailable. In such situations, the control unit may receive downlink communications from the surface of the drilling system to increment a stage or select a stage from the well plan based on a single downlink communication. Conventional downlink communications can include five or more discrete downlink communications to change settings of the BHA and change stages. Reducing the downlink communication duration can increase uptime on the drilling system.

In some embodiments, the drilling system can communicate downhole with the control unit and/or BHA by mud pulses. For example, a drilling fluid or mud flows downward through the drill string to the control unit and/or BHA as described herein. By varying a flow rate and/or a fluid pressure of the drilling fluid, the drilling rig at the surface of the drilling system can transmit instructions to the control unit and/or BHA. In a conventional system, the downlink communication includes a plurality of mud pulses in the downhole direction, where each mud pulse is of varying duration to communicate or select settings in the BHA. In some examples, the borehole and/or drill string can be long, introducing fluidic drag into the mud pulses, requiring each mud pulse to be a minute or longer. A sequence of mud pulses, therefore, can take several minutes or longer to communicate a relatively simple change to BHA settings.

In some embodiments, the drilling system can communicate downhole with the control unit and/or BHA by RPM pulses. For example, the drilling rig applies a torque to change the revolutions per minute (RPM) of the drill string to communicate with the control unit and/or BHA. By varying an RPM of the drill string through a series of changes or at a particular RPM, the drilling rig at the surface of the drilling system can transmit instructions to the control unit and/or BHA. In a conventional system, the downlink communication includes a plurality of RPM pulses, where each RPM pulses is of varying duration and/or RPM to communicate or select settings in the BHA. In some examples, the borehole and/or drill string can be long, introducing significant torsional elasticity, fluidic drag, friction with a borehole wall and other variables into the communication of the transmission of the RPM pulse in the downhole direction. The delay and/or noise (e.g., torsional oscillations) in the transmission of the RPM pulses can require each RPM pulse to be a minute or longer to effectively communicate the signal to the control unit and/or BHA. A sequence of RPM pulses, therefore, can take several minutes or longer to communicate a relatively simple change to BHA settings.

In some embodiments, a method of changing stages of a well plan with a downhole control unit using a single downlink communication significantly shortens the communication duration and increases uptime on the drilling system. In some embodiments, the method includes storing a plurality of stages of a well plan on a hardware storage device of a downhole tool. In some embodiments, the well plan is stored locally on the hardware storage device of the control unit, such as described herein. In some embodiments, the well plan is at least partially stored on a hardware storage device of another downhole component, such as a directional steering tool. In some examples, the control unit includes a well plan of pre-determined stages that are stored on the directional steering tool, such as a first stage with a first target azimuth and/or inclination and a second stage with a second target azimuth and/or inclination. The control unit communicates with the directional steering tool to change the directional steering tool from the first stage to the second stage, although the portion of the well plan stored on the control unit will not include the specific values or parameters of the first stage and second stage.

In some embodiments, the method further includes drilling a first portion of a borehole according to a first stage of the well plan with the downhole tool. The drilling system drills the first portion of the borehole according to the values associated with the first stage, such as a DLS for a curved stage, a target azimuth and/or inclination for a linear stage, an ROP, or other drilling parameters. In some embodiments, one of more components of the drilling system dynamically adjust values to meet the target values of the well plan. For example, the directional steering tool may dynamically adjust lateral forces applied by actuatable bias pads to hold a target inclination and/or azimuth. In another example, the drilling system dynamically adjusts a rotational speed of the drill bit to maintain a target ROP according to the well plan.

The method further includes receiving a single downlink communication at the control unit and/or BHA. In some embodiments, the single downlink communication is a mud pulse communication. In some embodiments, the single downlink communication is an RPM pulse. Based at least partially on the single downlink communication, the method includes selecting a stage of the plurality of stages stored on the hardware storage device. For example, the single downlink communication may instruct the control unit to increment the well plan forward one stage, selecting the next stage in the well plan. In some examples, the single downlink communication may instruct the control unit to select a sixth stage from the plurality of stages. In such an embodiment, the well plan may be dynamically adjusted or changed based on the downlink communications by building a well plan or profile through selections of a pre-determined set of stages. By selecting pre-determined stages from the plurality of stages stored on the hardware storage device, a plurality of settings or values can be changed by the control unit based on a single downlink communication.

The method further includes setting at least one operating value (target azimuth, target inclination, ROP, DLS, etc.) of the downhole tool based on the selected stage stored on the hardware storage device and drilling a second portion of the borehole according to the second stage of the well plan.

It should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein, to the extent such features are not described as being mutually exclusive. Numbers, percentages, ratios, or other values stated herein are intended to include that value, and also other values that are "about", "substantially", or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims. The described embodiments are therefore to be considered as illustrative and not restrictive, and the scope of the disclosure is indicated by the appended claims rather than by the foregoing description.

What is claimed is:

1. A method of controlling a downhole tool, the method comprising:

storing a well plan on a hardware storage device of a downhole tool, wherein the well plan includes a plurality of stages;

drilling with the downhole tool a first portion of a borehole according to a first stage of the well plan, wherein the first stage belongs to the plurality of stages of the well plan stored on the hardware storage device of the downhole tool;

selecting a second stage of the well plan in response to receiving a single downlink communication, wherein the second stage belongs to the plurality of stages of the well plan stored on the hardware storage device of the downhole tool;

setting at least one of a dogleg severity (DLS) and a rate of penetration (ROP) of the downhole tool based on the selected second stage of the well plan stored on the hardware storage device; and drilling a second portion of the borehole according to the selected second stage of the well plan.

2. The method of claim 1, wherein the plurality of stages of the well plan stored on the hardware device are predetermined prior to drilling.

3. The method of claim 1, wherein setting at least one of the DLS and the ROP is based at least partially on a true vertical depth of the downhole tool.

4. The method of claim 1, wherein setting at least one of the DLS and the ROP is based at least partially on an inclination of the downhole tool.

5. The method of claim 1, wherein setting at least one of the DLS and the ROP is based at least partially on an azimuth of the downhole tool.

6. The method of claim 1, wherein setting at least one of the DLS and the ROP is based at least partially on a toolface of the downhole tool.

7. The method of claim 1, wherein setting at least one of the DLS and the ROP includes changing both the DLS and the ROP.

8. The method of claim 1, wherein setting at least one of the DLS and the ROP is based at least partially on a formation measurement.

9. The method of claim 1, wherein selecting the second stage of the well plan is based on incrementing a stage of the well plan.

10. The method of claim 1, further comprising dynamically adjusting the well plan by selecting stages from the plurality of stages stored on the hardware storage device.

11. The method of claim 1, wherein setting at least one of the DLS and the ROP includes setting a target azimuth.

12. A method of controlling a downhole tool, the method comprising:

storing a well plan on a hardware storage device of a downhole tool, wherein the well plan includes a plurality of stages and a first trigger indicating a transition from a first stage to a second stage of the plurality of stages;

drilling with the downhole tool a first portion of a borehole according to a first stage of the well plan, wherein the first stage belongs to the plurality of stages of the well plan stored on the hardware storage device of the downhole tool;

setting target azimuth and target inclination of the downhole tool based on detection of the first trigger of the well plan and the second stage of the well plan stored on the hardware storage device; and drilling a second portion of the borehole according to the second stage of the well plan.

13. The method of claim 12, wherein the first stage is a curved stage of the well plan and the second stage is a linear stage of the well plan.

14. The method of claim 12, wherein the trigger is based on directional information or measurements from one or more sensors of the downhole tool.

15. The method of claim 14, further comprising:

setting the target azimuth and target inclination of the downhole tool based on detection of a second trigger of the well plan for a third stage of the well plan stored on the hardware storage device; and drilling a third portion of the borehole according to the third stage.

16. The method of claim 15, wherein the second trigger includes different parameters than the first trigger.

* * * * *